US007819690B2

(12) United States Patent
Faulkner et al.

(10) Patent No.: US 7,819,690 B2
(45) **Date of Patent: *Oct. 26, 2010**

(54) ELECTRICAL CONNECTOR FOR PIERCING A CONDUCTIVE MEMBER

(75) Inventors: Scott Anthony Faulkner, Harrisburg, PA (US); Walter Perec, Bethel, CT (US)

(73) Assignee: Otis Elevator Company, Farmington, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/913,432

(22) PCT Filed: Jan. 24, 2006

(86) PCT No.: PCT/US2006/002286

§ 371 (c)(1),
(2), (4) Date: Nov. 2, 2007

(87) PCT Pub. No.: WO2006/127059

PCT Pub. Date: Nov. 30, 2006

(65) Prior Publication Data

US 2008/0200077 A1 Aug. 21, 2008

(51) Int. Cl.
*H01R 4/24* (2006.01)

(52) U.S. Cl. ..... 439/397

(58) Field of Classification Search ..... 439/397, 439/395, 391, 404

See application file for complete search history.

(56) References Cited

U.S. PATENT DOCUMENTS 3,027,536 A * 3/1962 Pasternak ..... 439/403
3,930,708 A * 1/1976 Wedekind et al. ..... 439/397
4,062,615 A 12/1977 Navarro
4,087,150 A * 5/1978 Kubik ..... 439/397
4,145,920 A * 3/1979 Yamagami ..... 73/158
4,169,646 A * 10/1979 Stape et al. ..... 439/397
4,260,212 A * 4/1981 Ritchie et al. ..... 439/395
4,421,374 A * 12/1983 Montilla et al. ..... 439/408
4,820,190 A * 4/1989 Humphrey ..... 439/395
4,902,241 A * 2/1990 Lockard ..... 439/395
5,052,945 A * 10/1991 Shimomura et al. ..... 439/394

(Continued)

OTHER PUBLICATIONS

International Preliminary Report on Patentability mailed Dec. 6, 2007 for International application No. PCT/US06/02286.

(Continued)

*Primary Examiner*—Renee S Luebke
*Assistant Examiner*—Vladimir Imas
(74) *Attorney, Agent, or Firm*—Carlson, Gaskey & Olds PC

(57) ABSTRACT

A connector (50) is useful for making an electrically conductive connection with at least one conductive member. A disclosed example has one use for making such a connection with a tension member (32) in an elevator load bearing assembly (30). An example connector (50) includes projections (54) having a unique configuration that withstands compressive and bending forces associated with piercing through at least a portion of a conductive member (32). A disclosed example includes a generally concave surface (64) and a generally convex surface (66) along at least a portion of each projection. In a disclosed example, the projections at least partially lie on opposite sides of a centerline (68) of the connector (50).

13 Claims, 4 Drawing Sheets

U.S. PATENT DOCUMENTS

| | | | | |
|---|---|---|---|---|
| 5,076,801 | A * | 12/1991 | Schroll | 439/404 |
| 5,120,905 | A * | 6/1992 | Cousin et al. | 174/113 C |
| 5,121,310 | A * | 6/1992 | Ahroni | 362/238 |
| 5,426,362 | A * | 6/1995 | Ninnis | 324/235 |
| 5,834,942 | A * | 11/1998 | De Angelis | 324/522 |
| 6,073,728 | A * | 6/2000 | Olsen et al. | 187/414 |
| 6,425,785 | B1 | 7/2002 | Azuma | |
| 6,633,159 | B1 * | 10/2003 | Robar et al. | 324/240 |
| 7,210,956 | B2 * | 5/2007 | White | 439/395 |
| 7,540,359 | B2 * | 6/2009 | Veronesi et al. | 187/413 |
| 2004/0026177 | A1 * | 2/2004 | Ayano et al. | 187/247 |
| 2005/0090139 | A1 * | 4/2005 | White | 439/395 |
| 2008/0223668 | A1 * | 9/2008 | Stucky et al. | 187/393 |

OTHER PUBLICATIONS

International Search Report and Written Opinion of the International Search Authority mailed Sep. 24, 2007 for International application No. PCT/US06/02286.

* cited by examiner

ELECTRICAL CONNECTOR FOR PIERCING A CONDUCTIVE MEMBER

FIELD OF THE INVENTION

This invention generally relates to electrical connectors. More particularly, this invention relates to electrical connectors for at least partially piercing a conductive member for making an electrically conductive connection with the conductive member.

DESCRIPTION OF THE RELATED ART

A variety of electrical connectors are known. Some are designed for a particular purpose. Some applications include male and female connector portions that are designed for a relatively easy connection. Others involve forcing a connector through an insulating coating on a so-called flex cable, for example. In the latter cases, the connector typically has a pointed tip for penetrating through a insulating coating to make electrical contact with a target conductor.

Whatever the situation, an electrical connector must have good conductive properties to establish a reliable connection that does not introduce undesirable resistance in the intended conductive path. Situations requiring a connector to mate with a hard metal conductor present special challenges. On the one hand, soft and highly conductive metals are preferred for conductive characteristics. Choosing a harder metal reduces the quality of the electrical connection. On the other hand, known connector designs including soft metals are not capable of withstanding significant bending or compressive forces like those involved with penetrating a hard metal conductor. Therefore, known connectors are not suitable for making some types of electrical connections.

Modern elevator systems present one example situation where a particular type of electrical connector would be useful is for providing enhanced monitoring capabilities, for example. Elevator systems typically include a load bearing assembly having ropes or belts that bear the weight of the car and counterweight and allow the car to be moved as desired within the hoistway. For many years, steel ropes were used. More recently, coated belts and ropes have been introduced that include a plurality of tension members encased within a jacket. In one example, the tension members are steel cords and the jacket comprises a polyurethane material.

Such new arrangements present new challenges for monitoring the load bearing capabilities of the load bearing member over the life of the elevator system. With traditional steel ropes, manual, visual inspection techniques were often used to assess the condition of the rope. When a jacket is placed over tension members, they are no longer visible and alternative monitoring techniques are required. One possibility includes using electricity-based monitoring techniques.

Elevator load bearing assemblies present particular challenges when attempting to coordinate them with monitoring equipment. The nature of the jacket material makes it relatively difficult to establish an electrical connection between a monitoring device and the tension members within the jacket. Stripping off the jacket material to expose portions of the tension members tends to be labor-intensive and inconvenient. Additionally, it is not desirable to expose the otherwise covered tension members to the environment within a hoistway to avoid corrosion, for example.

Even if the jacket did not introduce such difficulties, tension members within the jacket comprise a hard metal such as steel. Piercing through a surface on a steel cord tension member presents challenges because it requires a connector that can withstand compressive forces sufficient to allow the connector to deform the surface of the tension member sufficiently for making an electrically conductive connection with the tension member.

Another challenge is presented by the need for accurately positioning an electrical connector relative to one or more tension members within a jacket. While the tension members in coated steel belts, for example, tend to be in an expected alignment along the length of the belt, there are variations in the positions of the tension members at different locations. It is necessary to be able to accommodate such position variations in a manner that provides for a reliable electrical contact between a monitoring device and the tension members.

There is a need for an electrical connector that is capable of establishing electrically conductive contact with hard metal conductors or tension members within an elevator load bearing assembly, for example.

SUMMARY OF THE INVENTION

An exemplary disclosed electrically conductive connector is useful for piercing a conductive member to establish an electrical connection with the tension member even if the conductive member comprises hard metal. One example connector includes a projection for at least partially piercing the conductive member. The projection has a non-linear body with a leading edge and two side edges at least partially transverse to the leading edge. At least one section of the body includes the two side edges intersecting a line and a location along the section between the side edges that is outside of the line.

In one example, the body comprises a curved surface along the section. In a disclosed example, one side of the body is generally concave while an oppositely facing side is generally convex.

Another example connector includes a generally planar base and a plurality of projections having a leading edge distal from the base. Each projection is at least partially at an oblique angle relative to the base and a distance between the leading edges is greater than a corresponding distance between a portion of the projections relatively closer to the base.

In one example, at least some of each projection is on an opposite side of a centerline of a generally planar base of the connector.

The various features and advantages of this invention will become apparent to those skilled in the art from the following detailed description of a currently preferred embodiment. The drawings that accompany the detailed description can be briefly described as follows.

DETAILED DESCRIPTION OF THE PREFERRED EMBODIMENT

The disclosed example connector is useful in a variety of situations where an electrical connection is desirable that involves at least partially piercing a conductive member. The disclosed example is also capable of piercing a coating, such as insulation, over the conductive member. The disclosed example is particularly well-suited for piercing hard conductive members. For purposes of discussion, a steel cord tension member in an elevator load bearing assembly will be used as an example conductive member. This invention is not necessarily limited to such a use.

Figure 1:
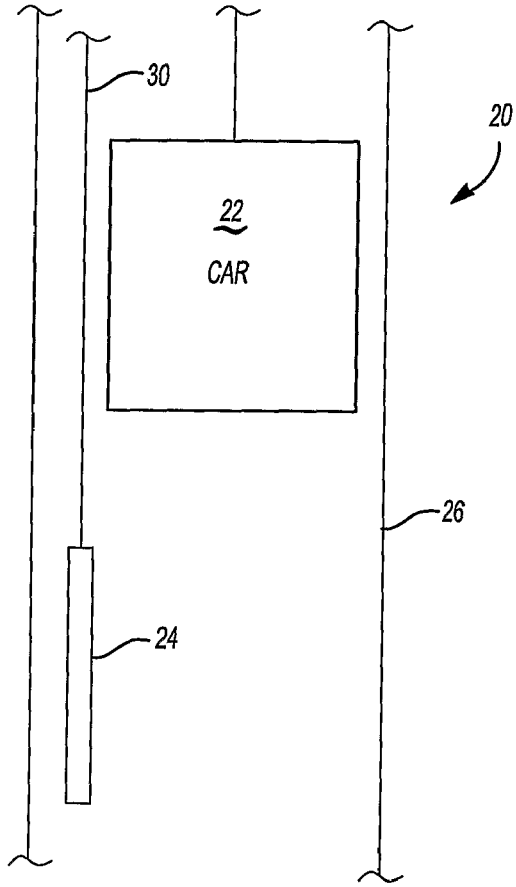
FIG. 1 schematically shows selected portions of an example elevator system.

FIG. 1 schematically shows selected portions of an elevator system 20. An elevator car 22 and a counterweight 24 move within a hoistway 26 in a known manner. A load bearing assembly 30 comprising a plurality of belts or ropes, for example, supports the weight of the elevator car 22 and the counterweight 24. The load bearing assembly 30 also provides for the desired movement of the car 22 in a known manner for operating a traction drive elevator system.

Figure 2:
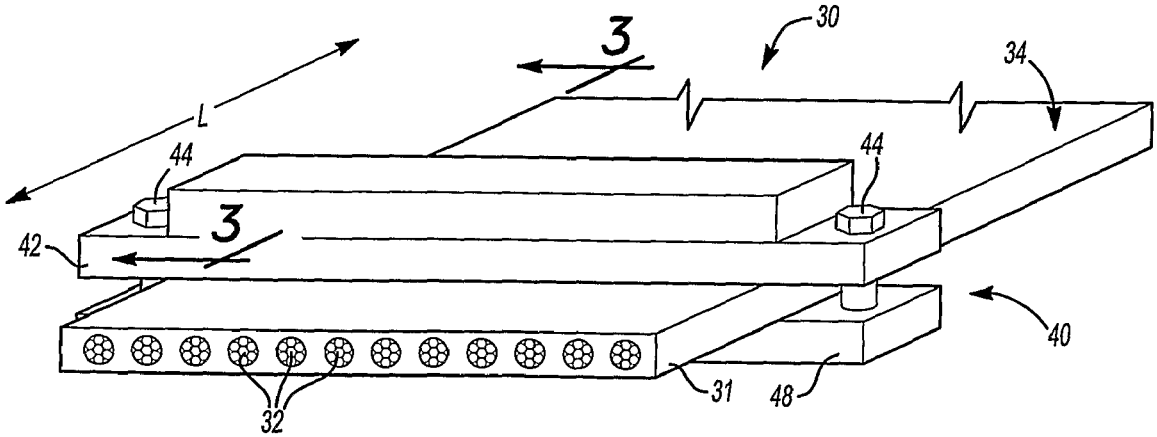
FIG. 2 schematically shows an example arrangement of a portion of a load bearing member and a monitoring device associated with it.

FIG. 2 schematically shows one example load bearing member from the assembly 30, which is a flat, coated steel belt 31. The example belt 31 includes a plurality of tension members 32, which comprise steel cords in this example. The tension members 32 extend generally parallel to each other in a longitudinal direction L along the length of the belt 31. The tension members 32 are encased in a jacket 34. In one example, the jacket 34 comprises a polyurethane material.

FIG. 2 also schematically shows an example monitoring device 40 coupled with the belt 31. In this example, the monitoring device utilizes an electricity-based monitoring technique for making determinations regarding the condition of the tension members 32 within the belt 31. The example device 40 includes a housing 42 that is received about an exterior of the belt 31 and held in place using adjusting members 44.

Figure 3:
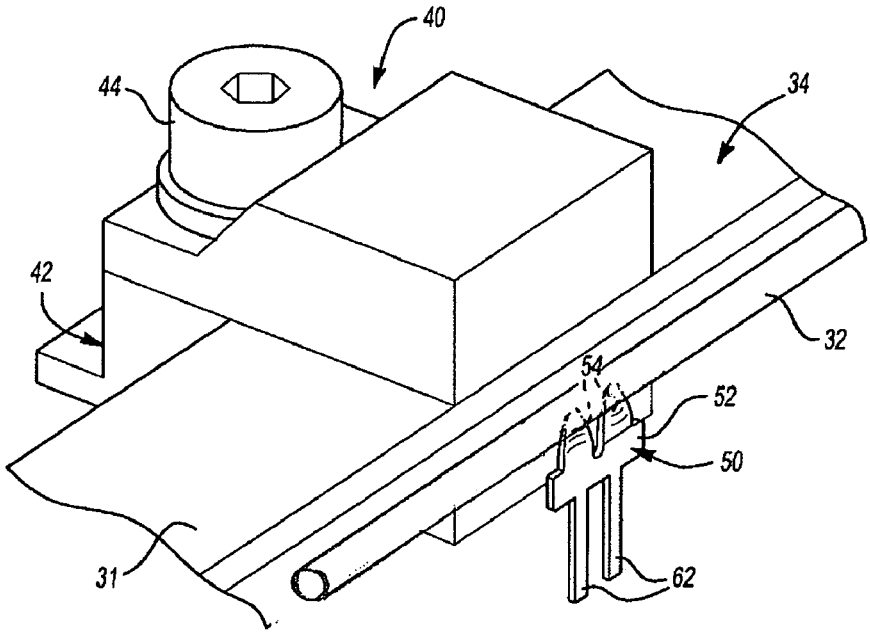
FIG. 3 is a perspective, partial sectional view taken along the lines 3-3 in FIG. 2.

As best appreciated from FIG. 3, the housing 42 supports a plurality of electrical connectors 50 that have a portion that penetrates at least partially into the belt 31 for making electrically conductive contact with at least selected ones of the tension members 32. The example connectors 50 have a base 52 that is generally planar and aligned with a longitudinal axis of the corresponding tension member 32. Two projections 54 extend away from the base 52. The projections 54 are the portion that penetrate through the jacket 34 and into the tension member 32.

The shape of the body of each projection 54 in this example is designed to withstand the compressive forces and bending forces experienced by the connector 50 as the projections 54 are moved into a position to make electrical contact with the tension member 32. In the illustrated example, the connectors 50 are forced into a conductive connection with the tension members 32 such that the projections 54 penetrate through at least a portion of the jacket 34 and a portion of the corresponding tension member 32. The forces associated with such motion are much higher than typical electrical connector arrangements can withstand. One example includes a force of approximately 30 pounds during the connection process.

In the context of making a connection with an elevator load bearing member, there are significant compressive and bending forces experienced by a connector while penetrating through a jacket and a portion of a tension member, which may comprises a hard metal such as steel. The example configuration of the body of each projection 54 accommodates such forces and provides a reliable connection device.

Each projection 54 has a leading edge 56 distal from the base 52. In this example, the leading edge 56 is generally blunt. The illustrated example includes a slightly rounded leading edge 56 rather than a pointed edge. In one example, a relatively dull or blunted leading edge 56 allows the connector 50 to be used in more than one connection attempt because the leading edge 56 does not become deformed significantly as it penetrates through a jacket and a tension member, for example.

Each example projection 54 has two side edges 58 and 60. The side edges 58 and 60 extend between the leading edge 56 and the base 52. In this example, the side edges are not parallel along the entire length of the body such that the body has a generally tapered shape. In other words, a dimension of the body near the leading edge 56 is smaller than a corresponding dimension of a portion of the projection 54 closer to the base 52. The tapered shape facilitates the projections penetrating through the appropriate portions of the load bearing member.

The example connector 50 has a pair of leads 62 extending away from the base 52 in a direction opposite from the projections 54. The leads 62 and the generally planar base 52 facilitate electrically coupling the connector 50 to an appropriate portion of monitoring electronics.

The example connector 50 is capable of withstanding compressive and bending forces, at least in part, because of a unique configuration of the body of each projection 54. As best appreciated from FIGS. 4 and 7, the example projections 54 have a generally concave surface 64 facing in one direction and a generally convex surface 66 facing in an opposite direction. In the illustrated example, the generally concave surfaces 64 face toward each other and toward a centerline 68 of the connector 50.

The curved surfaces in the illustrated example do not extend along the entire length of each projection 54. There is a transition portion 70 extending between the base 52 and the curved surfaces. The transition portion 70 in the illustrated example includes a generally concave surface 72 on the same side of the body as the concave surface 64. The transition portion 70 also includes a generally convex surface portion 74 on the same side of the convex surface 66. In one example, the shape of the projections is established using a forming or a coining technique and the transition portion 70 of each projection results from the forming or coining technique.

Figure 7:
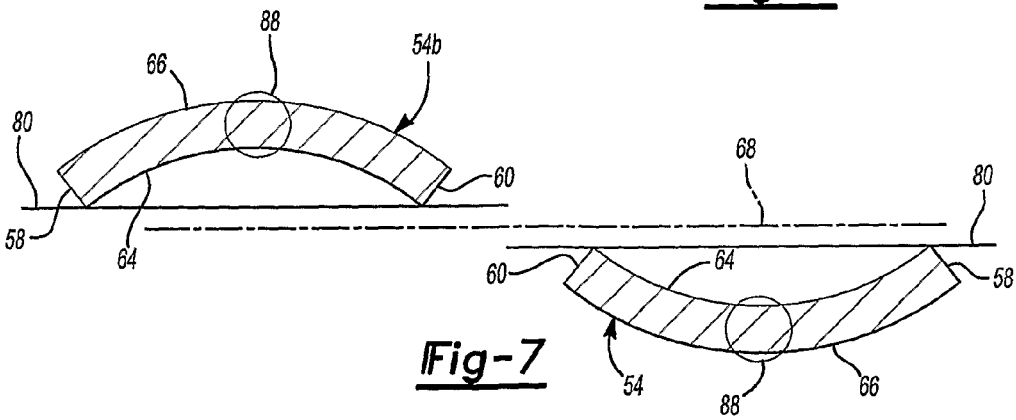
FIG. 7 is a sectional view taken along the lines 7-7 in FIG. 6.

As best appreciated from FIG. 7, a section of each projection 54 includes having the lateral edges 58 and 60 at least partially within a reference plane 80. A location 88 along the same section is outside of the plane 80. In the illustrated example, the locations 88 are at a central portion between the lateral edges 58 and 60 and are equidistant from the corresponding reference plane 80 for each projection.

Another example includes a surface 64 and an oppositely facing surface 66 that is not curved along the entire length between the side edges 58 and 60. The surfaces 64 and 66 comprise a plurality of generally linear segments in one example. Having a location 88 outside of the plane containing at least a portion of the lateral edges 58 and 60 along a section of the body of the projections 54 provides strength to each projection for withstanding the compressive and bending forces associated with at least partially penetrating a jacket 34 and a tension member 32 in an elevator load bearing member 31.

Figure 6:
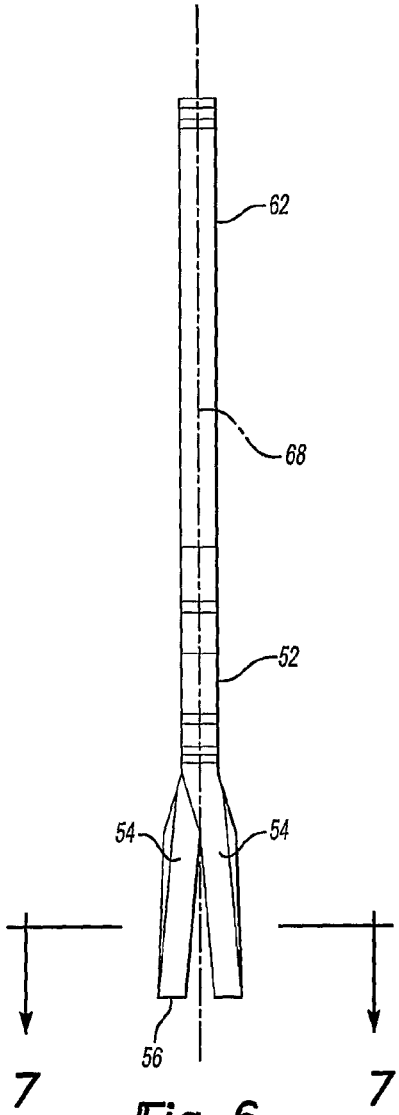
FIG. 6 is an elevational view of the embodiment of FIG. 4 from another angle.

As best appreciated from FIGS. 6 and 7, at least a portion of each projection 54 is aligned at an oblique angle relative to the centerline 68 of the example connector 50. In the illustrated example, each projection is on an opposite side of the centerline 68. This orientation of the projections provides for a more reliable connection with a target tension member 32. As can be appreciated from FIG. 3, for example, the base 52 is in line with the longitudinal axis of the tension member 32 when the connector device 40 is secured to the belt 31. Having the projections 54 oriented relative to a centerline 68 of the connector 50 as provided in the illustrated example better accommodates any misalignment between the tension member 32 and an expected location of that tension member. While such an orientation of the projections 54 increases the loading on each projection during the connection process, the unique configuration of each projection allows it to withstand such forces.

Figure 4:
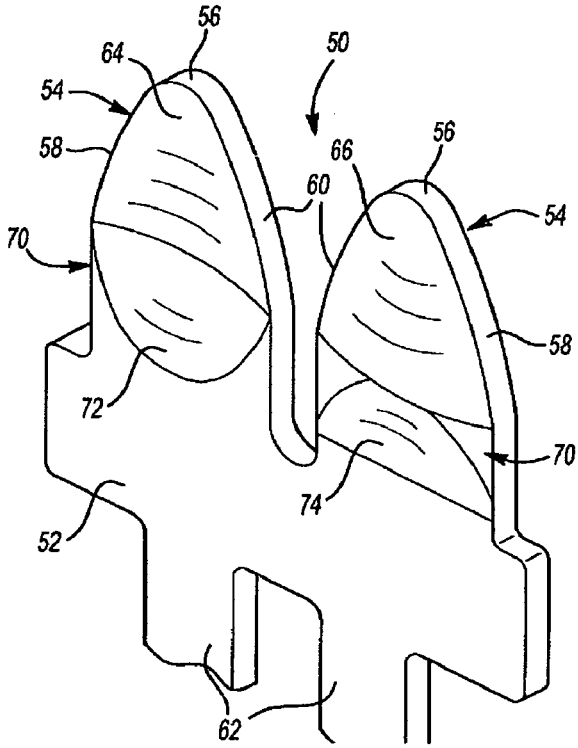
FIG. 4 is a perspective, diagrammatic illustration of one example connector embodiment.
Figure 5:
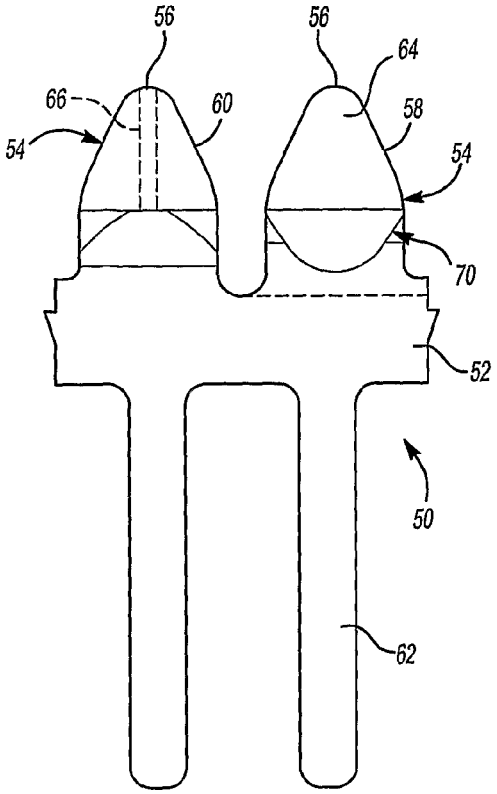
FIG. 5 is an elevational view of the embodiment of FIG. 4.
Figure 8A:
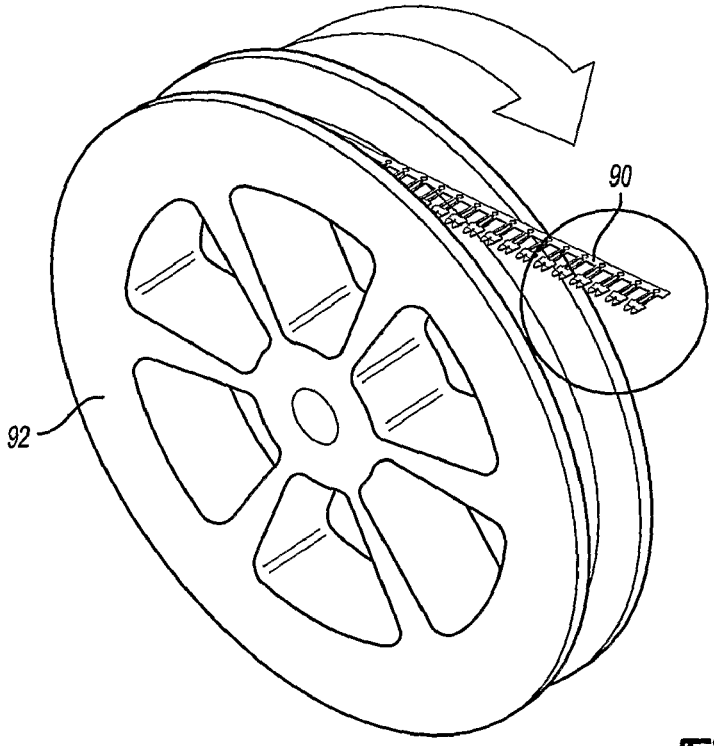
FIGS. 8A and 8B schematically illustrate a portion of an example manufacturing process for making an example connector designed according to one embodiment of this invention.
Figure 8B:
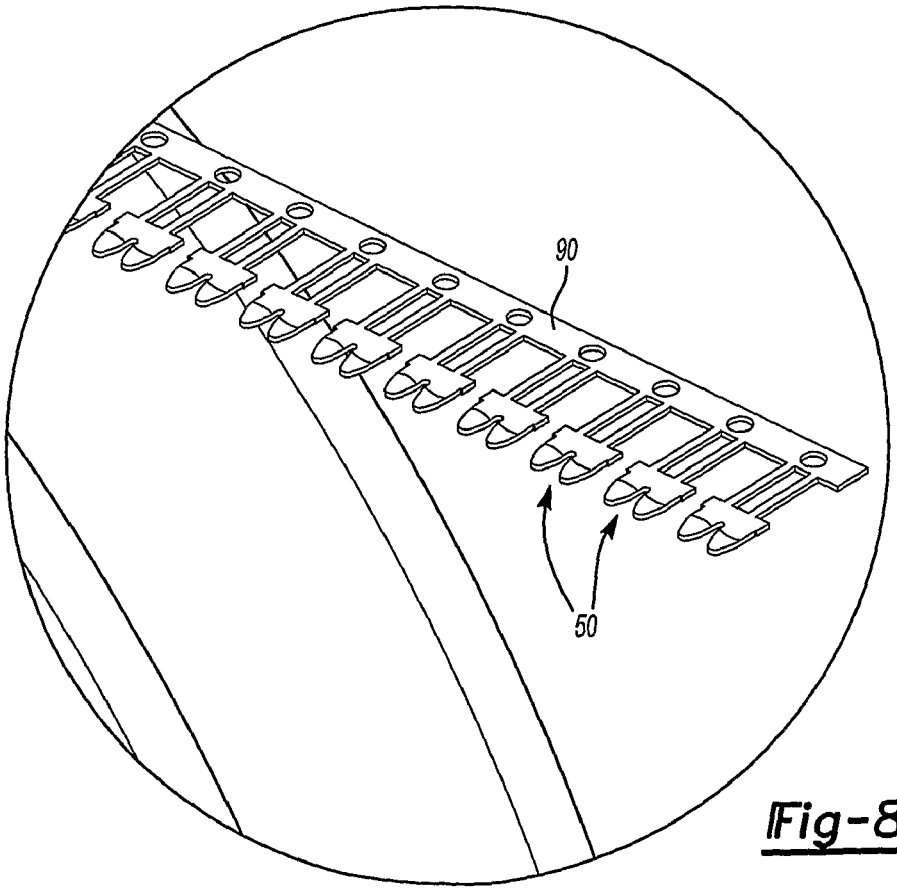

FIG. 8 schematically shows a portion of an example manufacturing process for making a plurality of connectors 50 designed according to the embodiment shown in FIG. 4. A blank strip of material is cut or stamped to establish the outer contour or general shape of a plurality of the connectors 50. The outer contour corresponds to the outline of the connector 50 in the elevational view of FIG. 5. Then a coining or other forming process establishes the contours of the surfaces on the projections 54.

In one example, a progressive die process including stamping followed by coining establishes the final configuration of each connector 50. The resulting strip 90 can be wound upon a wheel 92 as shown in FIG. 8 and the individual connectors 50 can be separated from the reel as needed.

The disclosed example allows for accommodating the various and sometimes competing requirements on an electrical connector. On the one hand, the connector must be suitably electrically conductive to provide meaningful measurement results. Conductive metals, however, tend to be soft. Soft materials are not typically capable of withstanding the forces associated with piercing and at least partially penetrating through a relatively hard conductive member. The illustrated example allows for utilizing a relatively soft, conductive metal connector that is capable of piercing and at least partially penetrating into such a conductive member (such as a steel cord tension member on an elevator load bearing member).

Various example materials are useful for making connectors as shown. Some example materials include bronze, copper, phos bronze, and alloys. Those skilled in the art who have the benefit of this description will realize what will work best for their situation.

In one example, the connector 50 and the projections 54 are capable of withstanding approximately 30 pounds of force used for making an electrically conductive, effective connection with at least one tension member 32. The example configuration of the body of each projection 54 prevents the projections from buckling under the compressive load associated with making the electrical connection. The unique shape and alignment of projections in the disclosed example provides reliable connections, enough strength to mate with a hard metal such as steel and conductivity associated with metals such as brass.

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

We claim:

1. An electrically conductive assembly, comprising:

an elevator load bearing member having at least one conductive tension member; and at least one electrically conductive connector including a projection at least partially piercing through and into the tension member, the projection having a non-planar body with a leading edge and two side edges at least partially transverse to the leading edge, at least one section of the body including the two side edges intersecting a line and a location along the section between the side edges that is outside of the line.

2. The assembly of claim 1, wherein the body comprises a curved surface.

3. The assembly of claim 2, wherein the curved surface extends an entire distance between the two side edges.

4. The assembly of claim 2, wherein the curved surface includes a first, generally concave side and a second, oppositely facing, generally convex side.

5. The assembly of claim 1, including a plurality of projections each having the body, leading edge and side edges.

6. The connector of claim 5, wherein at least a portion of each projection is on an opposite side of a centerline of the connector.

7. The assembly of claim 6, wherein each projection comprises a curved surface along the section and the curved surfaces face in opposite directions.

8. The assembly of claim 5, including a generally planar base and wherein each of the projections is at least partially at an oblique angle relative to the base and wherein a distance between the leading edges is greater than a corresponding distance between a portion of the projections relatively closer to the base.

9. The assembly of claim 1, wherein the leading edge is at least partially blunt.

10. The assembly of claim 1, wherein the side edges are spaced apart progressively farther in a direction from the leading edge toward a distal end of the side edges.

11. The assembly of claim 1, comprising a monitoring device associated with the connector, the monitoring device making a determination regarding a condition of the tension member.

12. The assembly of claim 1, wherein the load bearing member comprises a flat belt having a plurality of the tension members.

13. The assembly of claim 1, wherein the tension member is configured to support a load of an elevator car.

* * * * *